US006349851B1

(12) United States Patent
Lu

(10) Patent No.: US 6,349,851 B1
(45) Date of Patent: Feb. 26, 2002

(54) VOCAL DISPENSING DEVICE

(75) Inventor: Pao-Shu Lu, Taipei (TW)

(73) Assignee: Allure Home Creation Co., Inc., Boonton, NJ (US)

( * ) Notice: Subject to any disclaimer, the term of this patent is extended or adjusted under 35 U.S.C. 154(b) by 0 days.

(21) Appl. No.: 09/798,486

(22) Filed: Mar. 3, 2001

(30) Foreign Application Priority Data

Oct. 4, 2000 (TW) ..... 89217218 U

(51) Int. Cl.[7] ..... B67D 5/32
(52) U.S. Cl. ..... 222/39; 222/184; 340/683
(58) Field of Search ..... 222/39, 184; 340/683

(56) References Cited

U.S. PATENT DOCUMENTS 3,627,161 A * 12/1971 Wergeland ..... 446/81
4,247,844 A * 1/1981 Zapolski et al. ..... 222/39
4,898,060 A * 2/1990 To ..... 215/11.1
D318,794 S 8/1991 Litton et al.
5,258,209 A 11/1993 Bankert et al.
5,301,836 A 4/1994 Luu
D346,548 S 5/1994 Maddox
D348,388 S 7/1994 Kuzma
5,350,040 A * 9/1994 Gribble ..... 222/39
D352,234 S 11/1994 Costa
5,456,626 A * 10/1995 Ming-Kang ..... 222/39
D365,020 S 12/1995 Dihand
5,480,068 A * 1/1996 Frazier et al. ..... 222/184
5,489,893 A * 2/1996 Jo et al. ..... 215/11.1
D370,636 S 6/1996 Crawford
D376,310 S 12/1996 Crawford
6,024,625 A * 2/2000 Pearce ..... 215/11.1
6,104,292 A * 8/2000 Rombom et al. ..... 340/687
6,178,090 B1 * 1/2001 Cheng ..... 215/11.1

* cited by examiner

*Primary Examiner*—Philippe Derakshani

(57) ABSTRACT

A dispensing device includes a base on which a container is connected and a sound-emitting member is received in the base. A biasing member is biased between the container and the base. A valve is connected to the container and includes an outlet. The sound-emitting member is able to be activated by light, sound or vibration so that when user uses the valve, the sound-emitting member sends the pre-decided sound or message

4 Claims, 5 Drawing Sheets

VOCAL DISPENSING DEVICE

FIELD OF THE INVENTION

The present invention relates to a vocal dispensing device, and more specifically to a dispensing device that sends a sound or message when using the dispensing device.

BACKGROUND OF THE INVENTION

Conventional liquid dispensers such as shampoo and cleaning solution dispensers generally include a container with an open top and a pump type valve is inserted in the container with an outlet or nozzle extending from the valve and located outside the container. The user may activate the valve to pump solution or liquid in the container out from the outlet. However, the function of the conventional dispenser is so limited that it can only pump an amount of solution or liquid from the outlet. For commercial need, the container of the dispenser may have printed patterns of cartoon characters or animals on an outer surface thereof so as to attract children's attentions. The container of the dispenser can be shaped as cartoon characters, animals or any object that is in fashion. However, these dispensers do not provide any decorative value and are discarded when they are emptied. In other words, these empty dispenser are not useful for decoration purpose and this creates an adverse effect to the environment.

Because most of the containers of the dispensers are small and contain a limited amount of liquid, plenty of empty containers are discarded everyday. Another problem is that when two or three dispensers are put side by side and the types of the liquid received in the containers are different, for those who cannot see clearly, or young kids, to correctly use the dispenser to get the liquid they need is difficult.

In order to create a dispenser that overcomes the shortcomings mentioned above, reference is made to the following:

U.S. Pat. No. 5,258,209 to Bankert et al. relates to a decorative device for displaying an ornamental object within a fluid. The device takes the form of a transparent hollow bell-shaped enclosure, the interior of the enclosure containing a fluid and a plurality of small particles. A handle is attached to the crown of the enclosure. A fluid tight base is sealingly connected to the mouth of the enclosure.

U.S. Pat. No. 5,301,836 to Luu discloses a liquid dispenser having a movable head as a pump actuator. More specifically, it discloses a plastic container in the shape of an animal body for holding liquid.

U.S. Pat. No. Des. 365,020 to Dinand provides an ornamental design for a combined cosmetic container and cap.

U.S. Pat. No. Des. 318,794 to Litton et al. provides an ornamental design for a combined bottle and cap.

U.S. Pat. No. Des. 346,548 to Maddox provides an ornamental design for a combined pump dispenser and cap.

U.S. Pat. No. Des. 348,388 to Kuzma discloses an ornamental design for a pump dispenser.

U.S. Pat. No. Des. 370,636 to Crawford provides an ornamental design for a body of a bottle.

U.S. Pat. No. Des. 352,234 to Costa provides an ornamental design for a pump dispenser.

U.S. Pat. No. Des. 370,310 to Crawford provides an ornamental design for a bottle.

None of the patents discloses or suggests a dispenser that can assist those who cannot see clearly or the children to tell which dispenser is the one they need.

SUMMARY OF THE INVENTION

This invention relates to a dispensing device and comprises a base having a sound-emitting member connected thereto and a container mounted to the base with a biasing member biased between the container and the base. The sound-emitting member is connected to the valve so that when the valve is activated, the sound-emitting member sends a pre-decided sound to tell the user which dispenser is activated.

The primary object of this invention is to provide a dispensing device that is interactive with its user and that sends a sound, noise, phrase, music, or the like when the dispensing device is activated.

The other object of the present invention is to provide a dispensing device having a sculptured appearance wherein the sound generated corresponds with the appearance of the sculpture.

These objects, features, aspects and advantages of the present invention will become more obvious from a careful reading of a detailed description provided hereinafter with appropriate reference to the accompanying drawings.

DETAILED DESCRIPTION OF THE INVENTION

Figure 1:
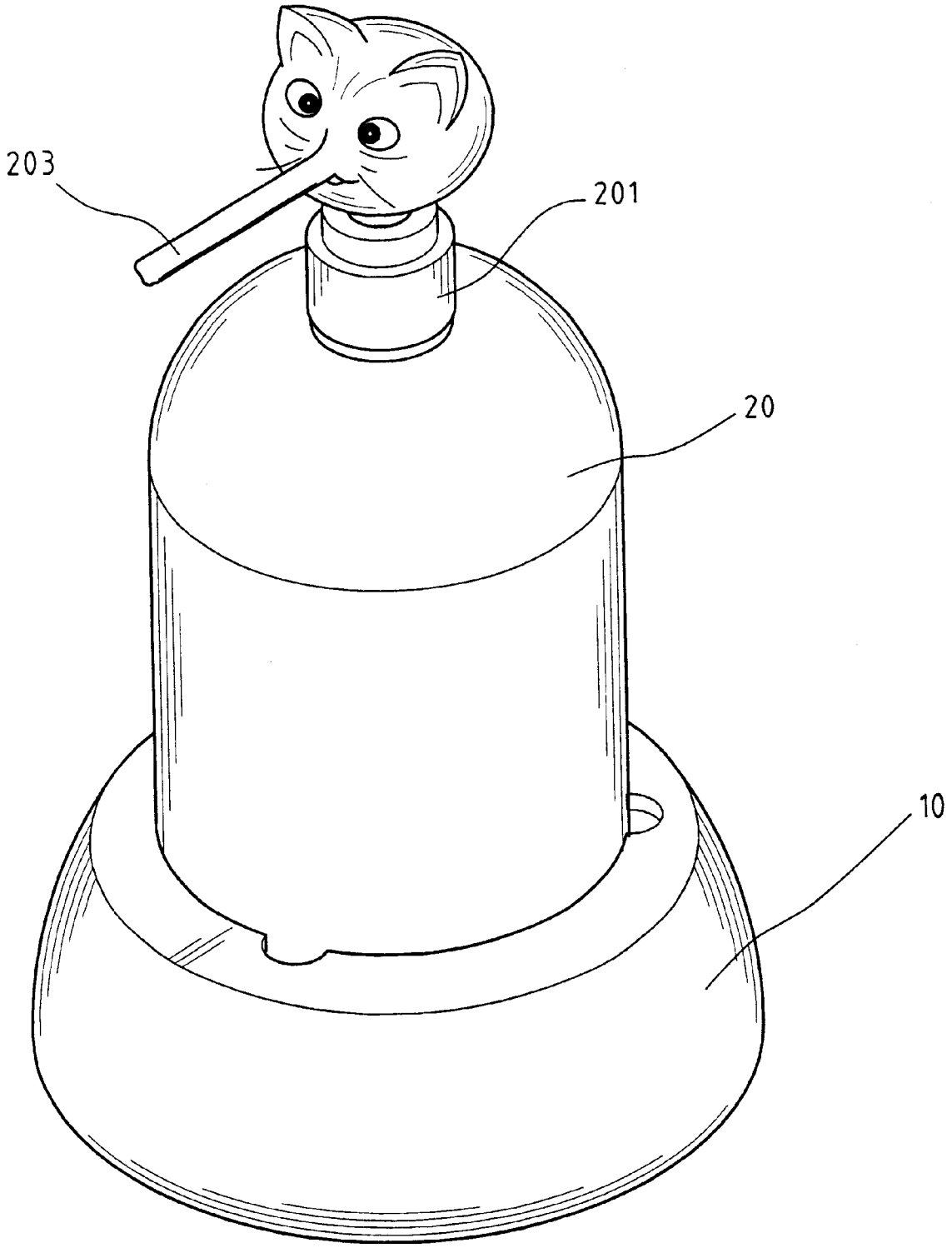
FIG. 1 is a perspective view of a dispensing device of the present invention.
Figure 2:
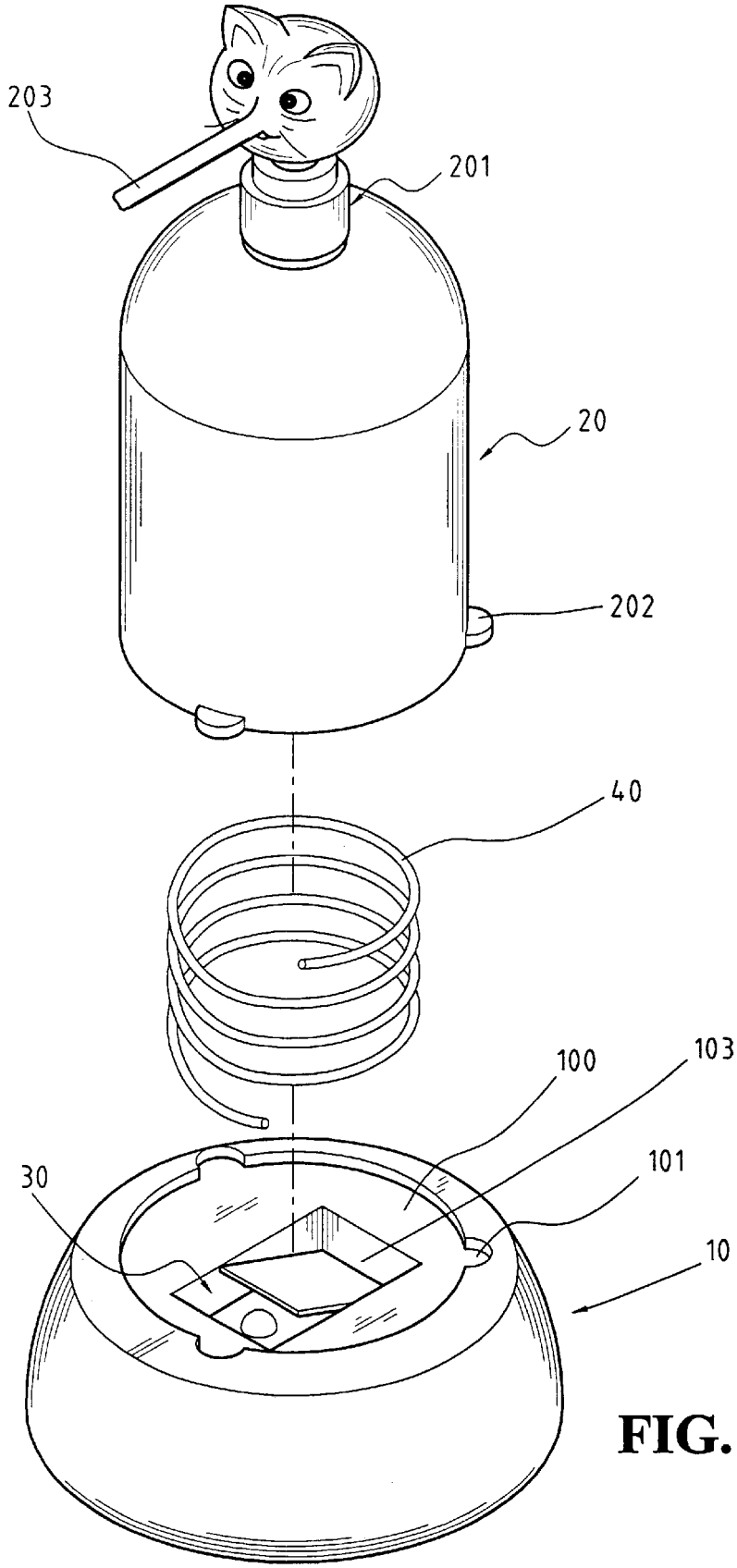
FIG. 2 is an exploded view to show the dispensing device of the present invention.

With reference to FIGS. 1 and 2, the dispensing device in accordance with this invention comprises a base 10 having a recess 100 defined in a top thereof and a flange 104 extends radially inward from a periphery of the recess 100. Three notches 101 are defined in an inner periphery of the flange 104. A container 20 is mounted to the base 10 and has three protrusions 202 extending radially outward therefrom. The protrusions 202 pass through the notches 101 and then rotated an angle to be engaged with an underside of the flange 104.

Figure 3:
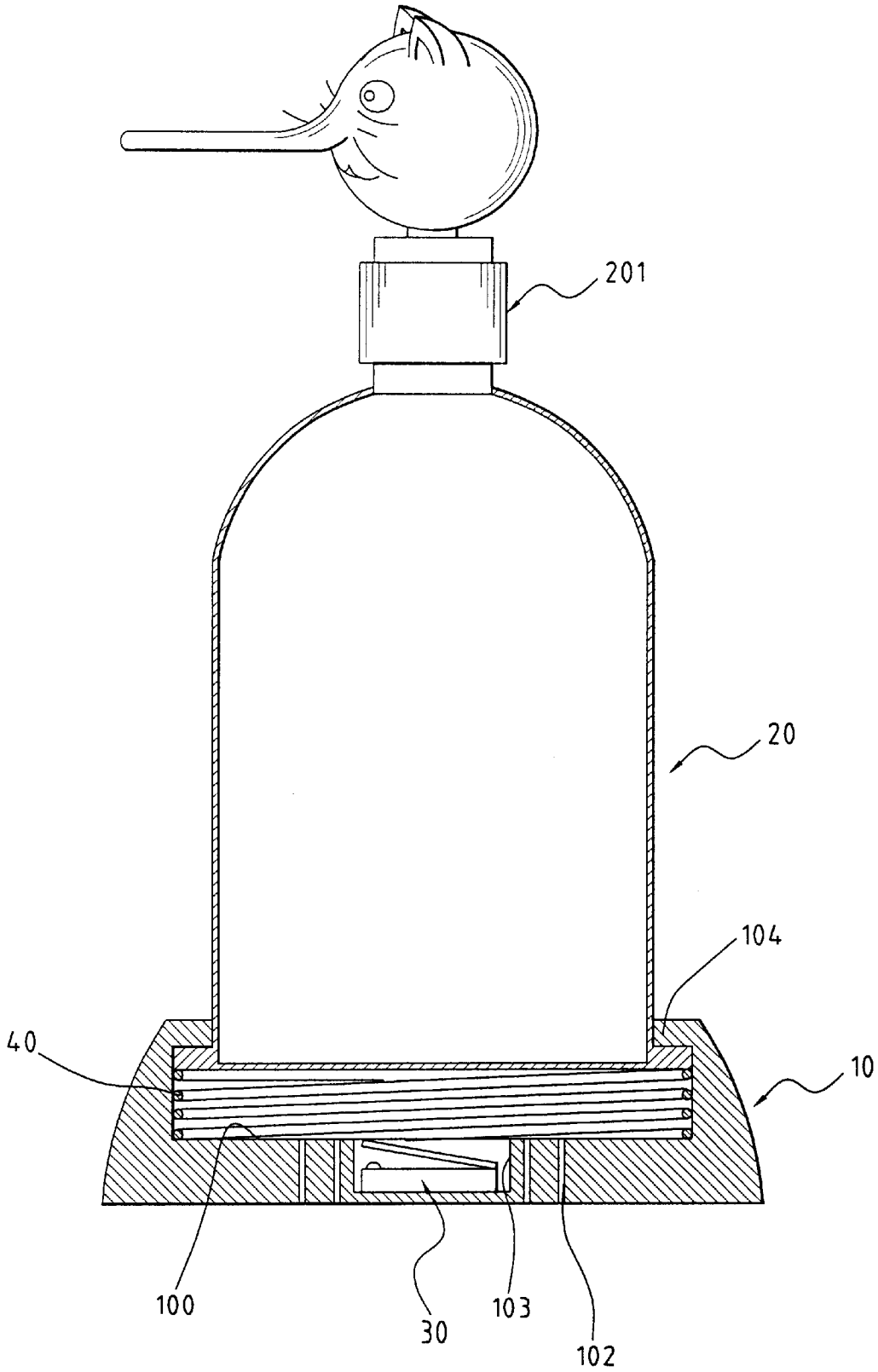
FIG. 3 is a cross sectional view of the dispensing device of the present invention.

Referring to FIG. 3, a biasing member 40 biases between the container 20 and the base 10 to apply an upward force to the underside of the container 10 such that the protrusions 202 are forced against the underside of the flange 104. A sound-cmitting member 30 is received in a recessed area 103 defined in a surface defining the recess 100. The biasing member 40 can be a spring or foam gel or the like which has bounce force. Four passages 102 are defined through the base 10 so that when pressing the valve 201, air in the space between the container 20 and the base 10 can be released. Also, the passages 102 strap no liquid in the recess 100 because the liquid in the recess 100 could damage the sound-emitting member 30. Besides, the passages 102 allow the sound emitted by the sound-emitting member 30 to be sent via the passages 102.

A valve 201 is connected to a top of the container 20 and an outlet 203 extends from the valve 201 and communicates with an interior of the container 20. The valve 201 is connected to the sound-emitting member 30 by a proper way so that when the valve 201 is used, for example, the valve 201 is pressed, the container 20 is lowered and touches the sound-emitting member 30 which then sends a sound, noise, phrase, music, or the like. By this way, the user knows which dispensing device is activated and the function of sending a sound involves an entertainment feature.

Figure 4:
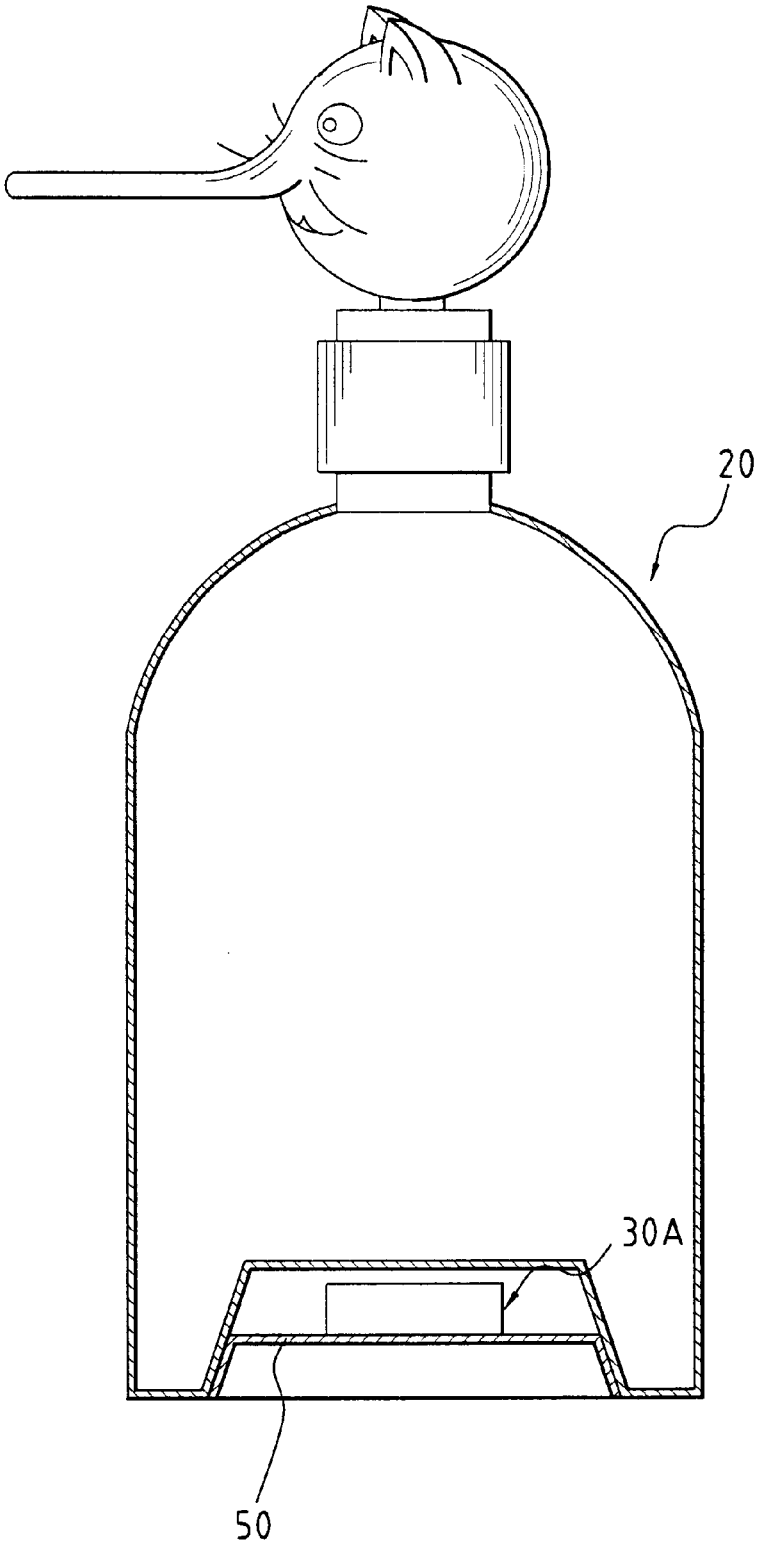
FIG. 4 is a cross sectional view of another embodiment of the dispensing device of the present invention.

FIG. 4 shows that the sound-emitting member 30A can be adhered on a base 50 which is then engaged with a recess defined in the underside of the container 20.

Figure 5:
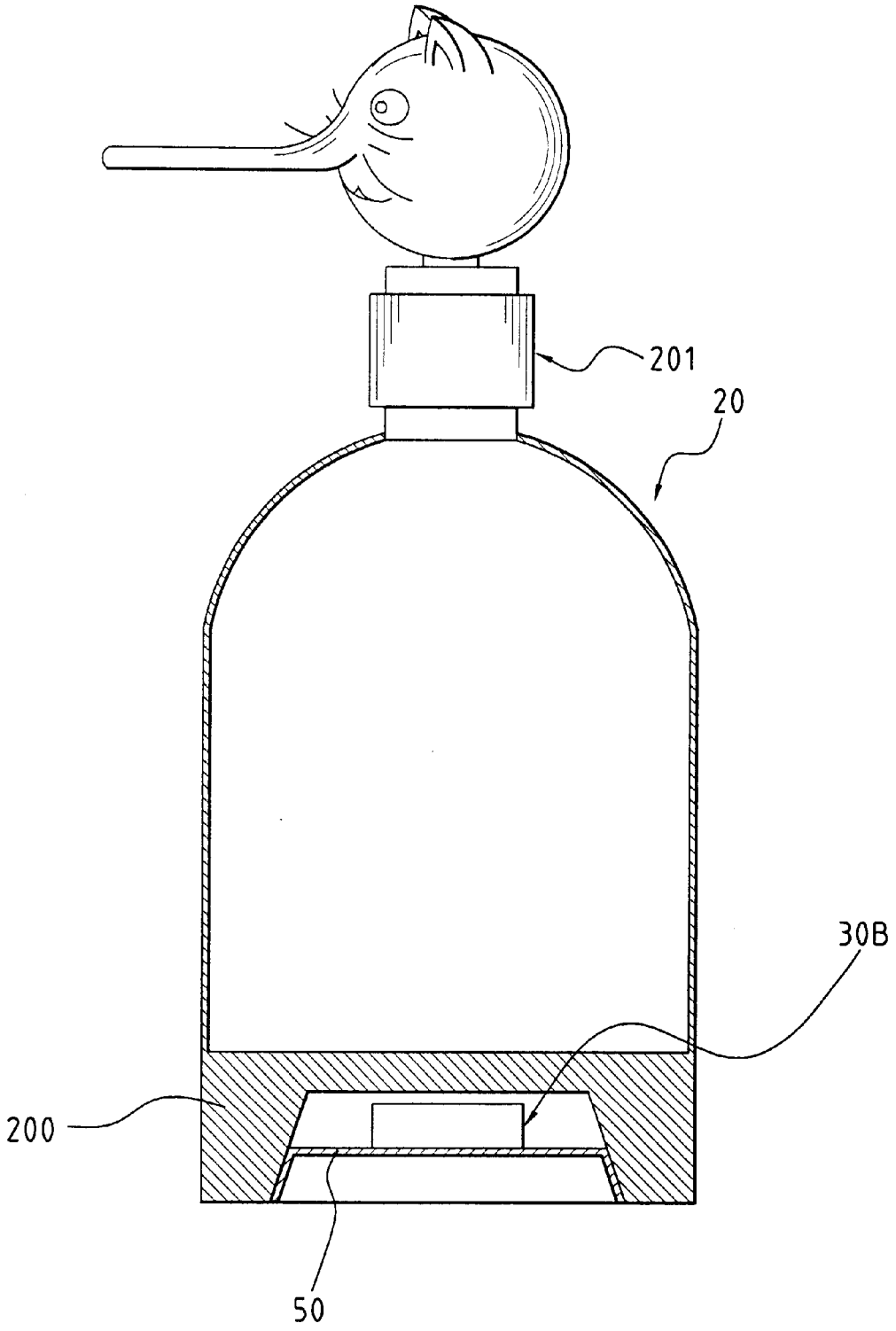
FIG. 5 is a cross sectional view of yet another embodiment of the dispensing device of the present invention.

FIG. 5 shows that the lower portion 200 of the container 20 is transparent and the sound-emitting member 30B is a light-activating member so that when the dispensing device is used in a light area, the sound-emitting member 30B is activated by pressing the valve 201. This is advantageous for the user putting the dispensing device in bed room or a room where is required to be quiet.

The sound-emitting member 30 can be designed to be activated by different ways, such as by vibration, sound, light, infra-red ray, radio frequency signal or pressure. The sound-emitting member 30 can also record and playback a noise, word, phrase, music or other desired audio signal or sound.

The valve 201 may have a sculptured appearance such as a cartoon character and the sound generated corresponds with the appearance of the sculpture. For example, if the dispensing device is in the shape of a cat, then the sound generated would be consisted with that made by a cat (e.g., "meow"). The container 20 or the valve 201 can be sculptured to resemble an animal such as a member in the fish family (e.g., goldfish, tropical fish), or a member in amphibian family (e.g., frog, toad, salamander), or a member in the reptile family (e.g., crocodile, alligator, turtle, tortoise), a member of the bird family (e.g., duck, goose, crow, rooster, chicken) or a member in the mammal family (e.g., cow, cat, dog, sheep, lamb, rabbit, hare). Advantageously, the dispensing device is in a form selected from group consisting of: a dog, a cat, a rooster, a duck, a dolphin, a cow, a tiger, a rabbit, a dragon, a snake, a horse, a sheep, a monkey, a pig, an insect (e.g., bee, fly, ladybug, ant, butterfly) and a seal; or, the dispensing device is in a form dispensing device of a plant or of an inanimate object, such as a tree, a mountain, and a flower, an electrical appliance, a locomotive or train, a car, an airplane, a jet, a space shuttle, a truck, a car (or generally, transportation means), a volcano, a building or structure (e.g., a house, a building or structure such as the Eiffel Tower, the World Trade Center, etc.), a sport equipment (bat, ball, hockey stick, etc). The dispensing device can also be formed as a famous person or character, and the sound-emitting member can emit a quote or phrase from that person or character (e.g., a "Clint Eastwood" or "Dirty Harry" or "George Bush" dispensing device that emits the phrase "Read My Lips" when activated, or a "Bugs Bunny" dispensing device that emits the phrase "What's Up Doc?" when activated, and the like). The sound-emitting member 30 can also sends music such as when the dispensing device is shaped as a baseball, the sound-emitting member plays "Take Me Out To The Ballpark", or if the dispensing device is shaped as a dog, the sound-emitting member plays "Hey Diddle Diddle". The container may have a enlarged letter protruding from or encaving in the surface of the container to assist the blind to distinguish the liquid in the container.

Although the present invention has been described with reference to the preferred embodiments, it will be understood that the invention is not limited to the details described thereof. Various substitutions and modifications can be made by those skilled in the art without departing from the scope of the invention as defined in the appended claims.

What is claimed is:

1. A dispensing device comprising:

a base having a top recess, a flange extending radially inward from a periphery of said top recess, a plurality of notches defined in an inner periphery of said flange, and a plurality of passages formed from said top recess through said base;

a sound-emitting member disposed in a recessed area within said base;

a container having an outlet and a bottom formed with protrusions extending radially outward, said protrusions passing through said notches and engaging with an underside of said flange to couple said container with said base; and a biasing member disposed between said container and said base;

wherein air between said container and said base is released through said passages when said container is lowered to activate said sound-emitting member for emitting sound, said sound being sent out via said passages.

2. The dispensing device as claimed in claim 1, wherein said biasing member is a spring.

3. The dispensing device as claimed in claim 1, wherein said outlet is connected to a valve member connected to said container.

4. The dispensing device as claimed in claim 1, wherein said base is transparent and said sound-emitting member is activated by sensing light.

* * * * *